US011771143B2

(12) United States Patent
Williams et al.

(10) Patent No.: US 11,771,143 B2
(45) Date of Patent: Oct. 3, 2023

(54) GARMENT HAVING KNITTED TECHNICAL WIRE

(71) Applicant: InDHouseLimited, Hong Kong (HK)

(72) Inventors: Tiffany Williams, Hong Kong (HK); Jackson Hoi Fung Chow, Hong Kong (HK); Vince Ho, Hong Kong (HK)

(73) Assignee: InDHouse Limited, Hong Kong (HK)

( * ) Notice: Subject to any disclaimer, the term of this patent is extended or adjusted under 35 U.S.C. 154(b) by 141 days.

(21) Appl. No.: 17/326,322

(22) Filed: May 20, 2021

(65) Prior Publication Data

US 2021/0360984 A1 Nov. 25, 2021

Related U.S. Application Data

(60) Provisional application No. 63/028,504, filed on May 21, 2020.

(51) Int. Cl.
*A41C 3/00* (2006.01)
*A41C 3/12* (2006.01)

(52) U.S. Cl.
CPC ..... *A41C 3/0007* (2013.01); *A41C 3/128* (2013.01)

(58) Field of Classification Search
CPC ..... A41C 3/0007; A41C 3/0028
USPC ..... 450/41
See application file for complete search history.

(56) References Cited

U.S. PATENT DOCUMENTS 5,669,247 A * 9/1997 McCartney ..... A41C 3/0007 66/171
6,082,145 A * 7/2000 Lonati ..... A41C 3/0007 66/190
6,685,535 B2 * 2/2004 Mitchell ..... D04B 1/246 450/75
8,317,568 B2 * 11/2012 He ..... D03D 7/00 450/49
9,833,024 B2 * 12/2017 Neng ..... D05B 35/02
2002/0155786 A1 * 10/2002 Querquant ..... A41C 3/0014 450/93
2010/0035514 A1 * 2/2010 Wong ..... A41C 3/0035 450/55

* cited by examiner

*Primary Examiner* — Gloria M Hale
(74) *Attorney, Agent, or Firm* — Bradley Arant Boult Cummings; Jacob Neu

(57) ABSTRACT

A knit garment having a knit technical wire is disclosed herein. The knit technical wire has two interwoven knit layers, such that they form an exterior or outward surface and an interior or body-facing surface. In between the exterior and interior surfaces and are at least one strand of yarn. The yarn may be a TPU yarn. The knit technical wire is used instead of a conventional underwire. The garment may be a woman's bra or dress that may conventionally be made with an underwire.

15 Claims, 5 Drawing Sheets

FIGURE 1
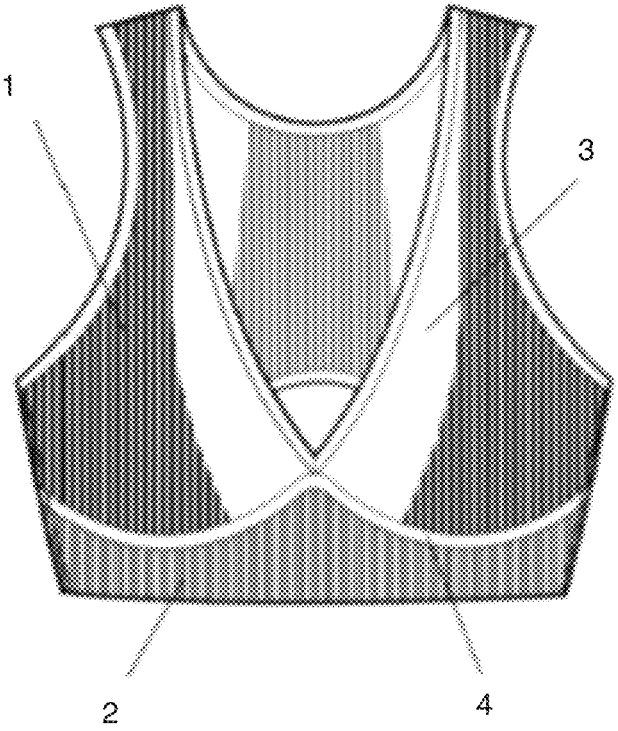
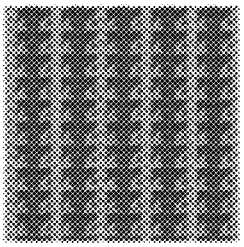
FIGURE 1A
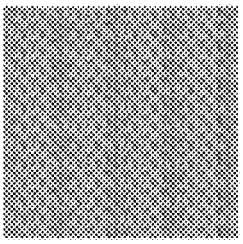
FIGURE 1B
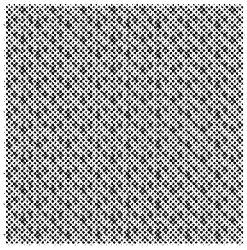
FIGURE 1C
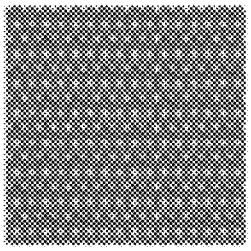
FIGURE 1D

GARMENT HAVING KNITTED TECHNICAL WIRE

CROSS-REFERENCE TO RELATED APPLICATIONS

This application claims the benefit of filing of U.S. Provisional App. No. 63/028,504 filed on May 21, 2020, and which is incorporated by reference herein.

BACKGROUND

Various types of garments or apparel may include underwires or technical wires for body support or garment support. For example, blouses, shirts, corsets, bras, swimsuits, camisoles, dresses, gowns, and other upper body garments may have underwires for use in supporting a wearer's breasts. Similarly, garments may have an underwire or other built-in support for a large abdomen, as may be the case when the wearer is pregnant or obese. In addition, wires may be used in connection with other support garments, such as knee pads, elbow pads, or shoulder pads, or on garments or costumes that require stiffened or supported fabric, such as petticoats.

Underwires on garments can be uncomfortable and cause rashes, chafing, scratches, or cysts on the wearer. Underwires can also be overly stiff in a manner that restricts movement. To reduce these effects, a knit technical "wire" is disclosed herein for providing support to a body part or garment.

BRIEF SUMMARY OF INVENTION

In some respects the invention relates to a garment having first portion and a second portion, the first portion being a band zone separated from the second portion by a knit technical wire, the knit technical wire formed of a first knit fabric and a second knit fabric interwoven together to form a front knit layer and a rear knit layer, and having a first yarn passing between the front knit layer and the rear knit layer.

In other respects the inventions relates to a bra having a cup zone, a body zone, and a band zone underneath the cup zone and body zone, wherein the band zone is separated from the cup zone and body zone by a knit technical wire, the knit technical wire formed of a first knit fabric and a second knit fabric interwoven together to form a front knit layer and a rear knit layer, and having a first yarn passing between the front knit layer and the rear knit layer.

BRIEF DESCRIPTION OF DRAWINGS

FIG. 1 shows a flat-knit support bra garment of the kind that may have a knit underwire, according to an embodiment of the disclosure.

FIGS. 1A-1D show sewing patterns used on the garment of FIG. 1.

DETAILED DESCRIPTION

Figure 2A:
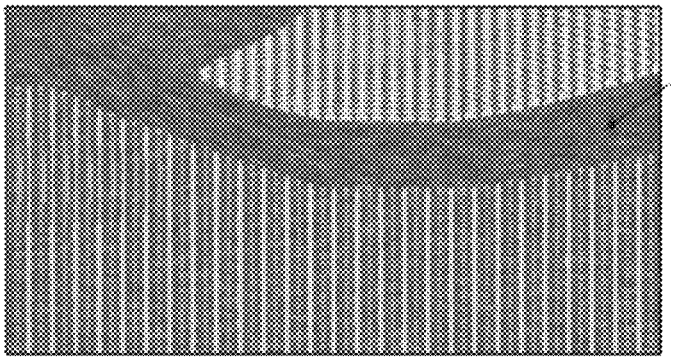
FIGS. 2A-2B show alternative embodiments of the knit technical wire of FIG. 1 with weave-in design, with the exterior or front knit layer visible in the figure.

Disclosed herein is a knit technical wire for use on garments. The garment may be any fabric apparel worn by a person, including but not limited to blouses, shirts, corsets, bras, swimsuits, camisoles, dresses, gowns, knee pads, elbow pads, shoulder pads, pads for other body parts, pants, shorts, underwear, or petticoats. As a non-limiting example disclosing the features of the knit technical wire in a particular garment, the following description references the knit technical wire as implemented on a soft-knit bra, but it is to be understood that the same construction and features of the knit technical wire may be used in connection with any garment worn by a person, including but not limited to those identified above in this paragraph.

FIG. 1 depicts a flat-knit support bra garment. In the depicted embodiment, the garment has multiple zones, each zone having a different knit or stitch to provide distinct properties to the garment in that zone. A cup zone 1 covers the front left lateral region and front right lateral region of the garment. The cup zone uses a fully-fashioned knit to provide shaping by goring the knit. (A goring technique is a knit-to-shape knitting motion, allowing flat fabric sections combined with tubular zones and circular shaped fabric sections. The fabric section can be straight, curved, or even spherical, which integrates into the knit designs, allowing for product shaping and fit adaptation.) The stitch may be a mock rib jacquard stitch with pointelle. An example of such a pattern is shown in FIG. 1A.

A body zone 3 is located in the front medial portion and the back portion of the garment. The body zone may be knitted as two panels, one for the front portion and one for the back portion covering the sides and shoulders of the wearer. The body zone may be a double knit jacquard stitch finished with a linking and overlocking stitch. An example of such a pattern is shown in FIG. 1B.

The bottom portion of the garment has a band zone 2, forming a band surrounding the body of the wearer. The band zone may use 2×1 rib and pointelle stitch. This provides a snug band that is tightly wrapped around the body of the wearer to support the garment on the torso. An example of such a pattern is shown in FIG. 1C.

The band zone 2 is separated from the cup zone 1 and the body zone 3 by the technical wire 4. In the design shown in FIG. 1, the technical wire is a knit technical wire, without any metal or plastic wire used. An example of such a pattern and knit technical wire is shown in FIG. 1D. The knit technical wire is used in place of the conventional underwire.

Turning to the knit technical wire, more particularly, the knit technical wire has a multi-material, "weave-in" knit construction. In some embodiments the knit technical wire has three layers: a front or exterior knit layer, a back or interior knit layer, and a middle layer. In some embodiments the middle layer is made of a thermoplastic polyurethane (TPU) yarn. A finishing heating treatment is applied to the final knitted construction to set the TPU yarn, providing increased strength and durability while reducing the extensibility of the TPU material. The heating treatment may occur at a temperature in a range of about 100 degrees Celsius to 165 degrees Celsius.

Figure 2B:
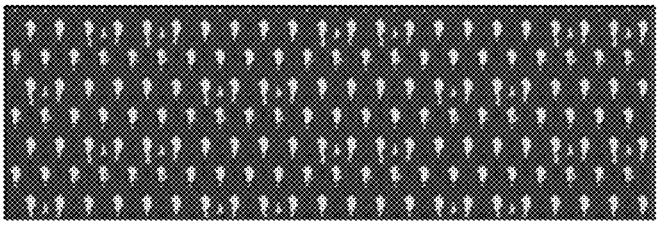

FIGS. 2A and 2B show additional embodiments of the knit technical wire with weave-in design, with the exterior or front knit layer visible in the figure.

Figure 3A:
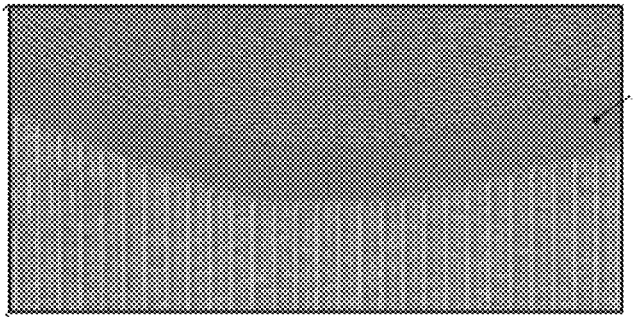
FIG. 3A-3B show alternative embodiments of the knit technical wire of FIG. 1 with weave-in design, with the interior or back knit layer visible in the figure.
Figure 3B:
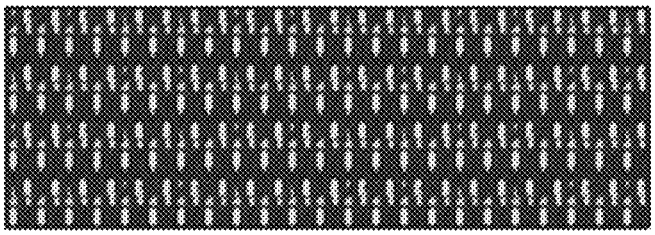

Similarly, FIGS. 3A and 3B show further additional embodiments of the knit technical wire with weave-in design, with the interior or back knit layer visible in the figure.

Figure 4:
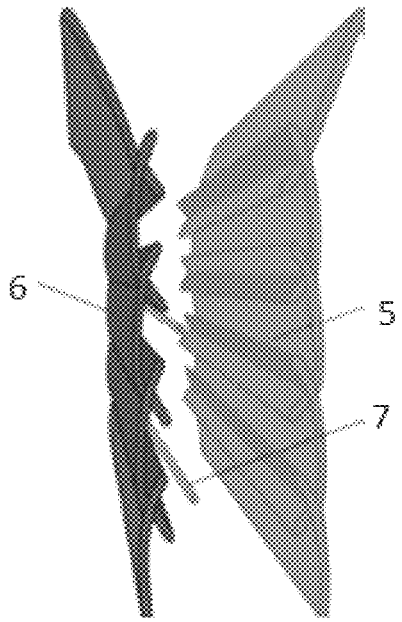
FIG. 4 depicts an exploded cross section of an embodiment of the knit technical wire.

FIG. 4 depicts an exploded cross section of an embodiment of the knit technical wire. The wire has two knit layers interwoven together. These form a front knit layer 5, shown on the right side of the cross-section, and a back knit layer 6, shown on the left side of the cross section. Between the two layers is the middle layer 7. In the depicted embodiment, the middle layer 7 is formed of two TPU yarns, which are shown woven in the space between the front knit layer 5 and the back knit layer 6.

Figure 5A:
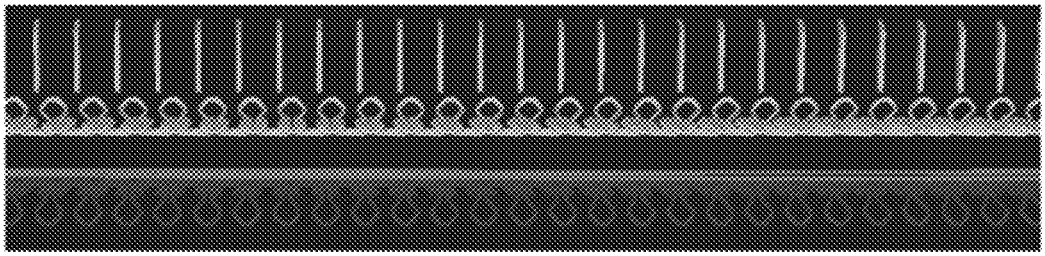
FIGS. 5A-5B show universal programming images for the knit technical wire according to an embodiment of the invention.
Figure 5B:
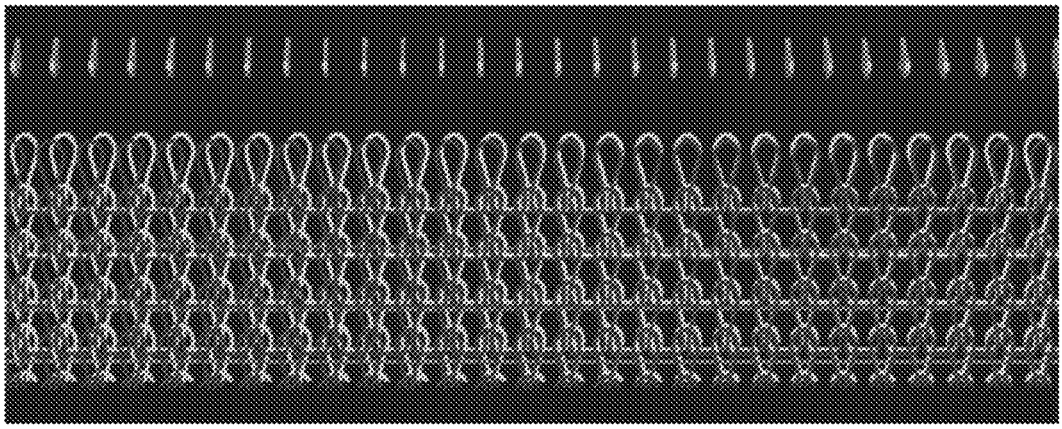

The three layers are woven together simultaneously. FIG. 5A shows the universal programming image for the knit technical wire from a bird's eye view. FIG. 5B shows the knit technical wire universal programming image from the front view.

Figure 6A:
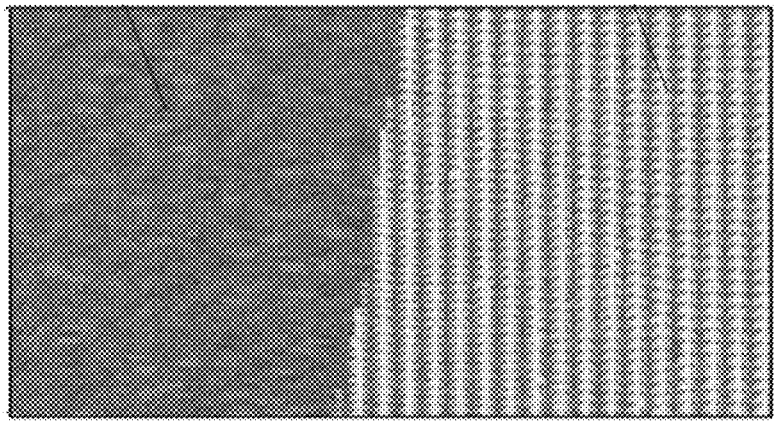
FIGS. 6A-6B show the universal programming image and resulting stitch design of the body zone and the cup zone stitches according to an embodiment of the invention.
Figure 6B:
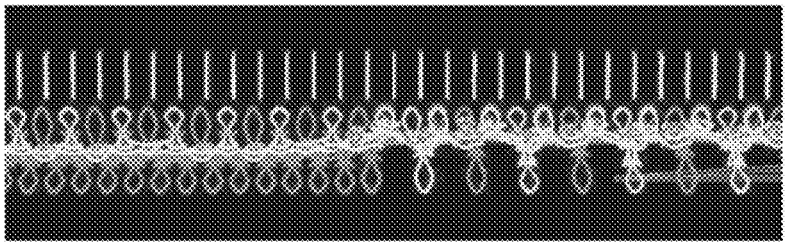

Returning to the other zones of the bra, the knit universal programming image of the body zone is shown in FIG. 6B. The resulting design of the body zone and the cup zone stitches are shown in FIG. 6A.

Figure 7A:
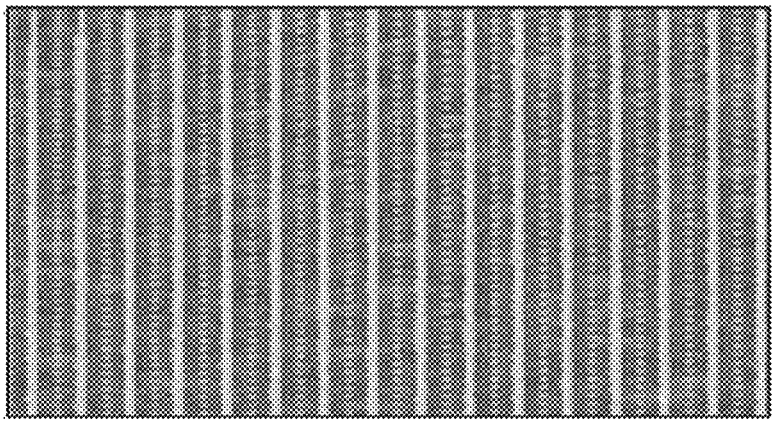
FIGS. 7A-7B show the universal programming image and resulting stitch design of the under chest band zone stitch according to an embodiment of the invention.
Figure 7B:
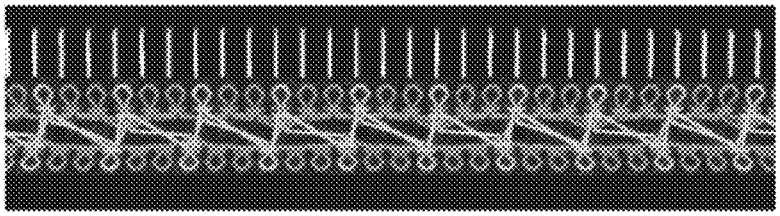

The under chest band zone knit universal programming image is shown in FIG. 7B. The resulting stitch pattern is shown in FIG. 7A.

Figure 8:
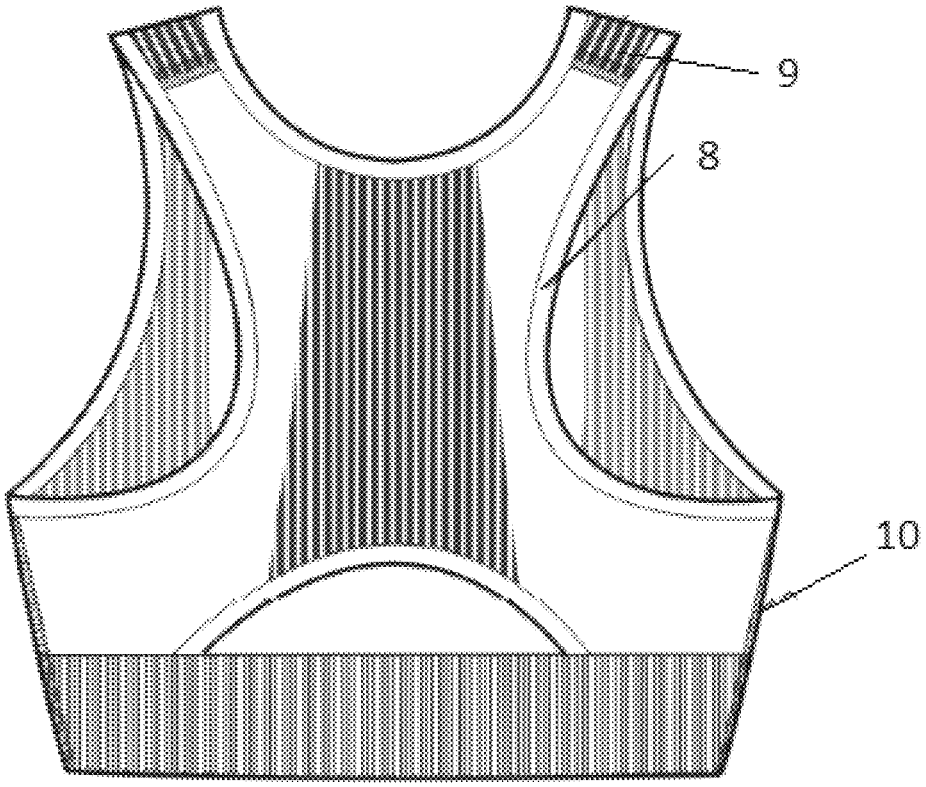
FIG. 8 shows a completed garment from the rear according to the embodiment of FIG. 1.

The garment is finished with a knit edge 8, a strap 9, and a seam 10, as shown in FIG. 8.

The knit technical wire disclosed provides support for low-impact activities, such as yoga, Pilates, barre, and casual/athleisure wear. The knit technical wire replaces the conventional underwire while providing a smooth, comfortable, supportive, and secure fit.

Other benefits and embodiments may be realized by those of ordinary skill in the art without departing from the scope of this disclosure.

We claim:

1. A garment comprising a first portion and a second portion, the first portion being a band zone separated from the second portion by a knit technical wire, the knit technical wire formed of a first knit fabric and a second knit fabric interwoven together to form a front knit layer and a rear knit layer, and having a first yarn passing between the front knit layer and the rear knit layer.

2. The garment of claim 1 wherein the first yarn is formed of TPU yarn.

3. The garment of claim 1 further comprising a second yarn passing between the front knit layer and the rear knit layer.

4. The garment of claim 3 wherein the first yarn and the second yarn are formed of TPU yarn.

5. The garment of claim 1 wherein the knit technical wire is formed of a weave-in knit construction.

6. The garment of claim 1 wherein the band zone is formed of a 2×1 rib and pointelle stitch.

7. A bra comprising a cup zone, a body zone, and a band zone underneath the cup zone and body zone, wherein the band zone is separated from the cup zone and body zone by a knit technical wire, the knit technical wire formed of a first knit fabric and a second knit fabric interwoven together to form a front knit layer and a rear knit layer, and having a first yarn passing between the front knit layer and the rear knit layer.

8. The bra of claim 7 wherein the first yarn is formed of TPU yarn.

9. The bra of claim 7 further comprising a second yarn passing between the front knit layer and the rear knit layer.

10. The bra of claim 9 wherein the first yarn and the second yarn are formed of TPU yarn.

11. The bra of claim 7 wherein the knit technical wire is formed of a weave-in knit construction.

12. The bra of claim 7 wherein the band zone is formed of a 2×1 rib and pointelle stitch.

13. The bra of claim 7 wherein the cup zone is formed of a mock rib jacquard stitch with pointelle.

14. The bra of claim 7, wherein the body zone is formed of a double knit jacquard stitch finished with a linking and overlocking stitch.

15. A garment comprising:

a lower portion comprising a band zone;

an upper portion comprising a body zone and a cup zone; and a knit technical wire between and connecting to each of the lower portion and the upper portion, the knit technical wire formed of a first knit fabric and a second knit fabric interwoven together to form a front knit layer and a rear knit layer, with a first yarn passing between the front knit layer and the rear knit layer.

* * * * *